US007997407B2

(12) United States Patent
Berger et al.

(10) Patent No.: US 7,997,407 B2
(45) **Date of Patent: *Aug. 16, 2011**

(54) SIDE-OPENING HINGE-LID CONTAINER WITH AUDIBLE INDICATION OF CLOSURE AND/OR OPENING

(75) Inventors: Roxane Berger, Yverdon (CH); Andre Dahan, Budapest (HU); Suzanne Girling, Lausanne (CH); Yorick Klipfel, Echichens (CH); Carsten Schlabach, Wuppertal (DE); Sandra Spielmann, Gletterens (CH)

(73) Assignee: Philip Morris USA Inc., Richmond, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/769,377

(22) Filed: Apr. 28, 2010

(65) Prior Publication Data

US 2010/0270185 A1 Oct. 28, 2010

Related U.S. Application Data

(63) Continuation of application No. 11/792,508, filed as application No. PCT/IB2005/004014 on Dec. 7, 2005, now Pat. No. 7,726,474.

(30) Foreign Application Priority Data

Dec. 8, 2004 (EP) ..... 04257626

(51) Int. Cl.
*A24F 15/00* (2006.01)
*B65D 85/10* (2006.01)

(52) U.S. Cl. ..... 206/268; 206/273; 206/263; 206/251; 229/160.1

(58) Field of Classification Search ..... 206/268, 206/265, 236, 242, 273, 271, 266; 220/125, 220/160.1, 122, 190
See application file for complete search history.

(56) References Cited

U.S. PATENT DOCUMENTS

| | | | | |
|---|---|---|---|---|
| 1,048,285 | A | 12/1912 | Brand | |
| 1,992,373 | A * | 2/1935 | Johnson | 206/268 |
| 2,958,417 | A | 11/1960 | Adams | |
| 3,037,678 | A * | 6/1962 | Caruso | 206/268 |
| 3,052,398 | A | 9/1962 | Benjamin | |
| 3,058,646 | A | 10/1962 | Guyer | |
| 3,583,625 | A | 6/1971 | Gero | |
| 3,881,599 | A | 5/1975 | Flaherty | |
| 4,294,399 | A | 10/1981 | Wilfer | |

(Continued)

FOREIGN PATENT DOCUMENTS

WO WO99/52791 10/1999

(Continued)

*Primary Examiner* — Mickey Yu
*Assistant Examiner* — Chun Cheung
(74) *Attorney, Agent, or Firm* — Buchanan Ingersoll & Rooney PC

(57) ABSTRACT

A side-opening hinge-lid container includes a body portion and a lid portion, each having a front wall, a rear wall, a top wall and a bottom wall. The lid portion is connected to the body portion along a hinge line for pivotal movement between a closed position and an open position. A body liner is mounted in the body portion and projects sideways into a space covered by the lid portion in the closed position. An outwardly extending ear is mounted on the liner. An inwardly extending flap is mounted to the lid portion for pivotal movement relative thereto. During pivotal movement of the lid portion between the open and closed positions, the flap engages the ear to produce a sound.

8 Claims, 4 Drawing Sheets

U.S. PATENT DOCUMENTS 5,067,615 A 11/1991 Davitian
5,129,513 A * 7/1992 David et al. ..... 206/265
5,826,785 A * 10/1998 Belvederi et al. ..... 229/162.3
6,105,856 A * 8/2000 Kakiuchi ..... 229/148
6,164,444 A * 12/2000 Bray et al. ..... 206/268
6,334,532 B1 * 1/2002 Tambo et al. ..... 206/268
6,719,131 B1 4/2004 Focke et al.
7,320,399 B2 * 1/2008 Ghini et al. ..... 206/268
7,726,474 B2 6/2010 Berger et al.

FOREIGN PATENT DOCUMENTS

WO WO03/008302 A1 1/2003

* cited by examiner

SIDE-OPENING HINGE-LID CONTAINER WITH AUDIBLE INDICATION OF CLOSURE AND/OR OPENING

This application is a continuation application of U.S. application Ser. No. 11/792,508 entitled SIDE-OPENING HINGE-LID CONTAINER WITH AUDIBLE INDICATION OF CLOSURE AND/OR OPENING, filed Jul. 16, 2007, now U.S. Pat. No. 7,726,474, which is a national stage application under 35 USC §371 of International Application Number PCT/IB2005/004014, filed Dec. 7, 2005, the international Application being published in English. This application also claims priority under 35 USC §119 to European Application No. 04257626.4, filed Dec. 8, 2004. The entire content of each being hereby incorporated by reference.

FIELD OF THE INVENTION

The present invention relates to a novel side-opening hinge-lid container and in particular to a novel side-opening hinge-lid pack for elongate smoking articles such as cigarettes.

BACKGROUND

Smoking articles such as cigarettes and a variety of other consumer goods are commonly sold in hinge-lid containers having a body portion and a lid portion, which is hinged to the body portion. In conventional hinge-lid cigarette packs, the lid portion of the pack is hinged to the top of the rear wall of the body portion thereof along a transverse hinge line and the cigarettes stand in the body portion of the upright pack with their longitudinal axes parallel to the longitudinal axis of the pack. When the consumer opens the pack, by pivoting the front of the lid portion up and to the rear, the upper ends of the cigarettes standing in the body portion are exposed, while in the closed position, the front wall, rear wall and side walls of the lid portion of the hinge-lid pack form vertical extensions of the corresponding walls of the body portion thereof.

As an alternative to such conventional "top-opening" hinge-lid cigarette packs, it is also known to provide "side-opening" hinge-lid cigarette packs wherein the lid portion of the pack is hinged to an elongate open side of the body portion thereof and the cigarettes are housed in the body portion of the pack with their longitudinal axes parallel to the elongate open side thereof. WO-A-99/52791, for example, discloses a side-opening hinge-lid cigarette pack in which the rear wall of the lid portion of the pack is pivotally connected to the rear wall of the body portion along a vertical hinge line, parallel to the longitudinal axes of the cigarettes therein. The pack disclosed in WO-A-99/52791 further comprises a liner mounted in the body portion of the pack, which projects from the open side of the body portion into the space covered by the lid portion in the closed position. In use, cigarettes standing in the body portion of the pack are partially enclosed by the liner, a side wall of which prevents sideways escape of the cigarettes from the pack.

U.S. Pat. No. 3,058,646 discloses an alternative side-opening hinge-lid cigarette pack in which the bottom wall of the lid portion of the pack is pivotally connected to the bottom wall of the body portion along a horizontal hinge line, perpendicular to the longitudinal axis of the cigarettes therein. Like the pack described in WO-A-99/52791, the pack of U.S. Pat. No. 3,058,646 also comprises a liner secured to the body portion of the pack, which projects from the open side of the body portion into the space covered by the lid portion in the closed position. As well as restricting sideways movement of cigarettes held in the body portion of the pack, the liner of the pack disclosed in U.S. Pat. No. 3,058,646 is also provided with a pair of opposed tabs that extend substantially parallel to the plane of the front and rear walls thereof. In order to hold the pack in the open or closed position, as desired, the free ends of these tabs are adhered to the inner surface of the front and rear walls of the lid portion of the pack. In use, as the lid portion is pivoted about the hinge line in order to open and close the pack, folding of the tabs flexes the front and rear walls of the lid portion of the pack outwardly, placing the tabs under compression and creating resistance to the opening and closing of the pack.

SUMMARY

According to the present invention there is provided a side-opening hinge-lid container comprising: a body portion having a front wall, a rear wall, a top wall and a bottom wall; a lid portion having a front wall, a rear wall, a top wall and a bottom wall, the lid portion being connected to the body portion along a hinge line for pivotal movement between a closed position, in which the interior of the body portion is inaccessible, and an open position, in which at least a portion of the interior of the body portion is accessible; a body portion liner having a front wall, a rear wall and a side wall, the body portion liner being mounted in the body portion and projecting sideways therefrom into a space covered by the lid portion in the closed position; at least one outwardly extending ear mounted on the body portion liner; and at least one inwardly extending flap hingedly mounted in the lid portion for pivotal movement relative thereto, wherein during movement of the lid portion from the open position to the closed position and/or from the closed position to the open position the at least one flap engages the at least one ear to produce a sound.

The production of a sound during movement of the lid portion of the hinge-lid container according to invention from the open position to the closed position and/or from the closed position to the open position advantageously provides the consumer with an audible indication of closure and/or opening, respectively, of the container. The production of a sound upon opening of a hinge-lid container according to the invention may advantageously be employed, for example, to provide an audible indication of tampering with the contents of the container. While the production of a sound upon closure of a hinge-lid container according to the invention may advantageously be employed, for example, to provide the consumer with an audible indication that the container has been correctly or fully closed.

Preferably, the front wall, the rear wall, the top wall and the bottom wall of the lid portion are parallel to and abut the front wall, the rear wall, the top wall and the bottom wall, respectively, of the body portion in the closed position. Preferably, the top wall, the front wall and the rear wall of the lid portion are spaced apart from the top wall, the front wall and the rear wall, respectively, of the body portion in the open position. Preferably, the bottom wall of the lid portion is connected to the bottom wall of the body portion along the hinge line. The lid portion and the body portion may, however, be hingedly connected along their rear walls so that the top wall, the bottom wall and the front wall of the lid portion are spaced apart from the top wall, the bottom wall and the front wall, respectively, of the body portion in the open position as in WO-A-99/52791.

Preferably, the container comprises a pair of opposed outwardly extending ears mounted on the body portion liner and a pair of opposed inwardly extending flaps hingedly mounted in the lid portion, wherein during movement of the lid portion from the open position to the closed position and/or during movement of the lid portion from the closed position to the open position the pair of opposed flaps engage the pair of opposed ears to produce a sound. The inclusion of a pair of opposed ears and a pair of opposed flaps advantageously permits louder audible indications of closure and/or opening of hinge-lid containers according to the invention to be produced.

Preferably, the container further comprises a lid portion liner mounted in the lid portion, the lid portion liner having a front wall and/or a rear wall. Preferably, the at least one inwardly extending flap is hingedly mounted on the front wall and/or a rear wall of the lid portion liner for pivotal movement relative thereto. Preferably, the front wall and/or the rear wall of the lid portion liner projects from the lid portion in the closed position sideways into the body portion. The inclusion of a lid portion liner advantageously provides reinforcement to the hinge-lid container.

Preferably, the container further comprises an inner frame mounted between the body portion and the body portion liner. Preferably, the front wall and/or the rear wall of the lid portion liner is slidably engaged in at least one slot provided in the front wall and/or a rear wall of the inner frame.

BRIEF DESCRIPTION OF THE DRAWINGS

The invention will be further described, by way of example only, with reference to the accompanying drawings in which.

DETAILED DESCRIPTION

Figure 1A:
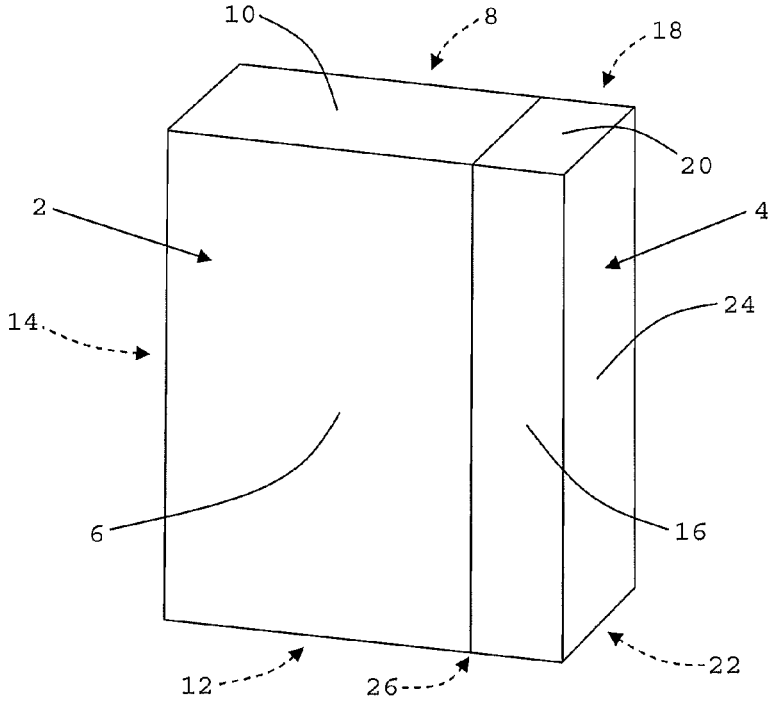
FIG. 1*a* is a front perspective view of an empty side-opening hinge-lid container according to the invention in the closed position.
Figure 1B:
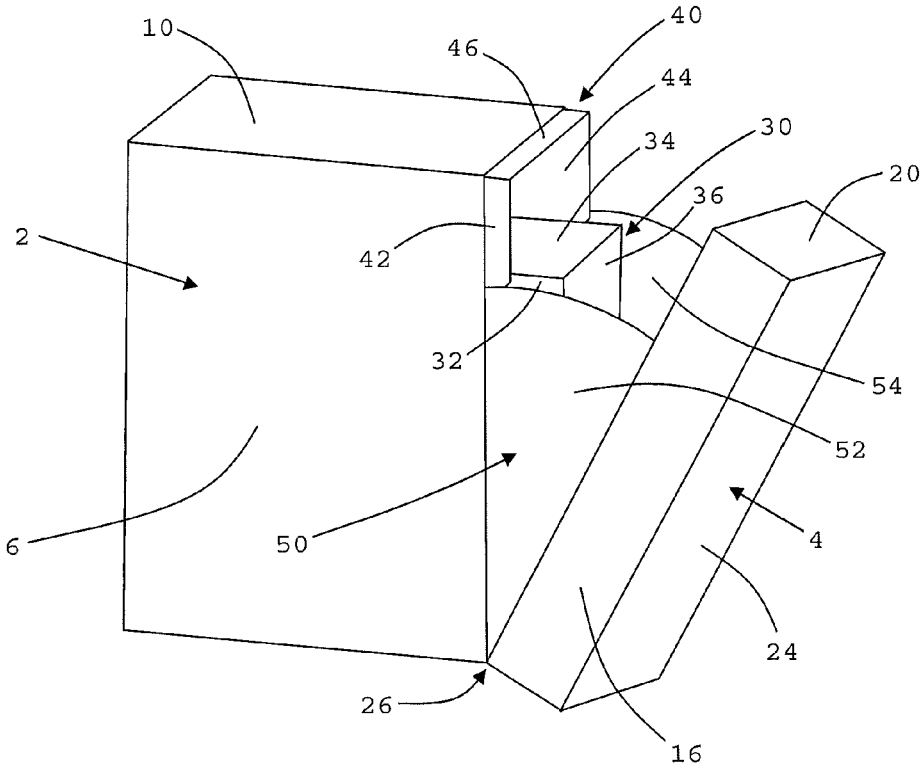
FIG. 1*b* is a front perspective view of the empty side-opening hinge-lid container of FIG. 1 in the open position.

The empty side-opening hinge-lid container shown in FIGS. 1*a* and 1*b* generally comprises a body portion 2 and a lid portion 4 hinged thereto. The body portion 2, which in use may, for example, house a plurality of elongate smoking articles such as cigarettes, comprises a front wall 6 and an opposed rear wall 8, a top wall 10 and an opposed bottom wall 12, and a body side wall 14. The lid portion 4 similarly comprises a front wall 16 and an opposed rear wall 18, a top wall 20 and an opposed bottom wall 22, and a lid side wall 24.

The edge of the bottom wall 22 of the lid portion 4 distant from the lid side wall 24 is connected along a hinge line 26 to the edge of the bottom wall 12 of the body portion 2 distant from the body side wall 14 for pivotal movement between the closed position, shown in FIG. 1*a*, and the open position, shown in FIG. 1*b*. When in the closed position shown in FIG. 1*a*, the lid portion 4 is disposed in side-by side abutting relation with the body portion 2, the front wall 16, rear wall 18, top wall 20 and bottom wall 22 of the lid portion 4 functioning as continuations of the corresponding walls of the body portion 2. When in the open position shown in FIG. 1*b*, the front wall 16, rear wall 18 and top wall 20 of the lid portion 4 are spaced apart from the front wall 6, rear wall 8 and top wall 10, respectively, of the of the body portion 2.

A body portion liner 30 having a front wall 32 and an opposed rear wall 34, and a side wall 36 is mounted in the body portion 2 of the hinge-lid container so that a portion of the front wall 32, a portion of the rear 34 wall, and the side wall 36 thereof project from the body portion 2 into the space covered by the lid portion 4 in the closed position shown in FIG. 1*a*. When the hinge-lid container is in the open position, the portion of the body portion liner 30 projecting from the body portion 2 is exposed in the region between the spaced apart front walls 6 and 16, rear walls 8 and 18 and top walls 10 and 20 of the body portion 2 and the lid portion 4, respectively, as shown in FIG. 1*b*.

An inner frame 40 having a front wall 42 and an opposed rear wall 44, and a top wall 46 is also mounted in the body portion 2 of the hinge-lid container, between the body portion 2 and the body portion liner 30, so that an upper portion thereof extends from the body portion 2 into the space covered by the lid portion 4 in the closed position.

A lid portion liner 50 having a front wall 52 and an opposed rear wall 54, with arcuate upper edges, and a side wall 56 (not shown) is mounted in the lid portion 4 of the hinge-lid container with the outer surface of the side wall 56 thereof facing the inner surface of the lid side wall 24 of the lid portion 4 so that the front wall 52 and the rear wall 54 of the lid portion liner 50 project beyond the front wall 16 and the rear wall 18, respectively, of the lid portion 4 into the body portion 2. The ends of the front wall 52 and the rear wall 54 of the lid portion liner 50 projecting into the body portion 2 of the hinge-lid container are received by a pair of opposed longitudinal slots (not shown) provided in the front wall 42 and the rear wall 44, respectively, of the inner frame 40 mounted therein.

Four separate cardboard blanks from which the body portion 2 and lid portion 4, the inner frame 40, the body portion liner 30 and the lid portion liner 50 of the hinge-lid container of FIGS. 1*a* and 1*b* are erected are shown in FIGS. 2, 3, 4 and 5, respectively. Corresponding reference numbers are used in FIGS. 2, 3, 4 and 5 for elements of the four blanks that are similar or related to elements of the body portion 2 and lid portion 4, the inner frame 40, the body portion liner 30 and the lid portion liner 50 previously described above. Each blank includes various panels and/or tabs which when folded about appropriate score lines (shown by broken lines) form the required part of the hinge-lid container shown in FIGS. 1*a* and 1*b*; the term score line is used to indicate a line formed by, for example, creasing, scoring, perforating, embossing or otherwise compressing, cutting and/or weakening the blank.

Figure 2:
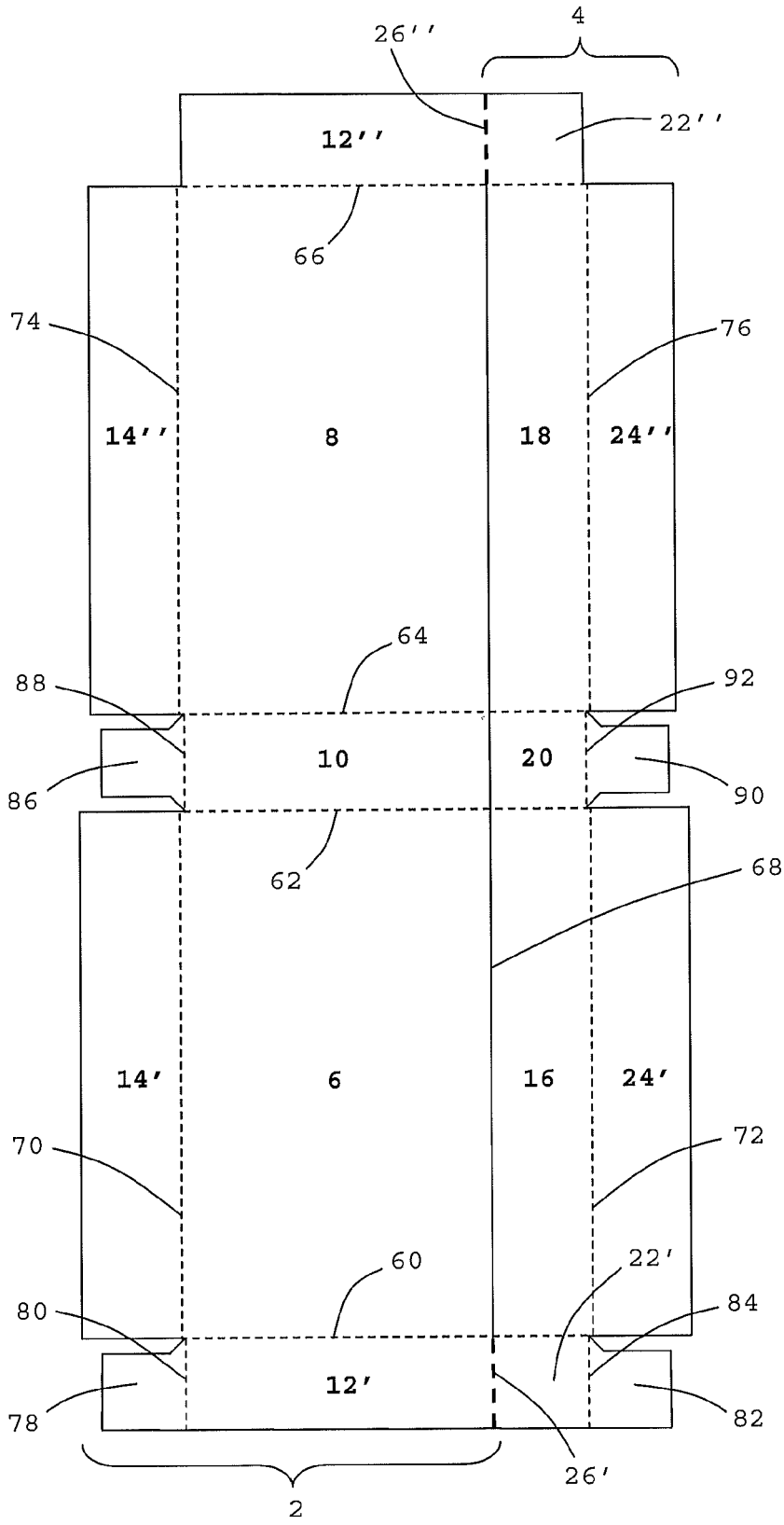
FIG. 2 is a plan view of the outer face of an elongate laminar blank for forming the body portion and the lid portion of the side-opening hinge-lid container of FIGS. 1*a* and 1*b;*

With reference to FIG. 2, the elongate laminar blank from which the body portion 2 and lid portion 4 of the hinge-lid container of FIGS. 1*a* and 1*b* is erected includes a body portion outer bottom wall panel 12', a body portion front wall panel 6, a body portion top wall panel 10, a body portion rear wall panel 8 and a body portion inner bottom wall panel 12", which are separated from one another in the longitudinal direction of the blank by a transverse first score line 60, a parallel second score line 62, a parallel third score line 64 and a parallel fourth score line 66, respectively. The blank further includes a lid portion outer bottom wall panel 22', a lid portion front wall panel 16, a lid portion top wall panel 20, a lid portion rear wall panel 18 and a lid portion inner bottom wall panel 22", which are adjacent to the corresponding body portion panels in the transverse direction of the blank. The lid portion outer bottom wall panel 22', lid portion front wall panel 16, lid portion top wall panel 20, lid portion rear wall panel 18 and lid portion inner bottom wall panel 22" are also separated from one another in the longitudinal direction of the blank by the first score line 60, second score line 62, third score line 64 and fourth score line 66, respectively.

The body portion outer bottom wall panel 12' and the lid portion outer bottom wall panel 22', and the body portion inner bottom wall panel 12" and the lid portion inner bottom wall panel 22" are separated from one another in the transverse direction of the blank by a pair of parallel hinge lines 26' and 26", respectively, which are perpendicular to the first score line 60, second score line 62, third score line 64 and fourth score line 66. The hinge lines 26' and 26", which are shown in FIG. 2 by bold broken lines, may be formed by, for example, creasing, scoring, perforating, embossing or otherwise compressing, cutting and/or weakening the blank.

The body portion front wall panel 6 and the lid portion front wall panel 16, the body portion top wall panel 10 and the lid portion top wall panel 20, and the body portion rear wall panel 8 and the lid portion rear wall panel 18 are separated from one another in the transverse direction of the blank by a cut 68 which is a collinear extension of the hinge lines 26' and 26" and which extends in the longitudinal direction of the blank from the first score line 60 to the fourth score line 66.

A body portion outer side wall panel 14' is connected to the side of the body portion front wall panel 6 distant from the lid portion front panel 16 along a fifth score line 70, which extends in the longitudinal direction of the blank from the first score line 60 to the second score line 62, perpendicularly thereto. A lid portion outer side wall panel 24' is similarly connected to the side of the lid portion front wall panel 16 distant from the body portion front wall panel 6 along a sixth score line 72, which is parallel to the fifth score line 70 and which also extends in the longitudinal direction of the blank from the first score line 60 to the second score line 62.

A body portion inner side wall panel 14" is connected to the side of the body portion rear wall panel 8 distant from the lid portion rear wall panel 18 along a seventh score line 74, which is collinear with the fifth score line 70 and extends in the longitudinal direction of the blank from the third score line 64 to the fourth score line 66. A lid portion inner side wall panel 24" is similarly connected to the side of the lid portion rear wall panel 18 distant from the body portion rear wall panel 8 along an eighth score line 76, which is collinear with the sixth score line 72 and which also extends in the longitudinal direction of the blank from the third score line 64 to the fourth score line 66.

The blank further comprises a body portion bottom wall flap 78 connected to the side of the body portion outer bottom wall panel 12' distant from the hinge 26' along a ninth score line 80, which is a substantially collinear extension of the fifth score line 70. A lid portion bottom wall flap 82 of substantially the same shape and size as the body portion bottom wall flap 78 is connected to the side of the lid portion outer bottom wall panel 22' distant from the hinge 26' along a parallel tenth score line 84, which is a substantially collinear extension of the sixth score line 72.

A body portion top wall flap 86 is connected to the side of the body portion top wall panel 10 distant from the cut 68 along an eleventh score line 88, which is a substantially collinear extension of the fifth score line 70. A lid portion top wall flap 90 of substantially the same shape and size as the body portion top wall flap 86 is connected to the side of the lid portion top wall panel 20 distant from the cut 68 along a parallel twelfth score line 92, which is a substantially collinear extension of the sixth score line 72.

During erection of the body portion 2 and lid portion 4 of the hinge-lid container of FIGS. 1*a* and 1*b* from the blank shown in FIG. 2, the body portion front wall panel 6 and the lid portion front wall panel 8 are folded through ninety degrees about the second score line 62 and the third score line 64, respectively, so that they are perpendicular to the body portion top wall panel 10 and the lid portion top wall panel 20. The body portion inner bottom wall panel 12' and the lid portion inner bottom wall panel 22', the body portion outer bottom wall panel 12" and the lid portion outer bottom wall panel 22", the body portion outer side wall panel 14', the body portion inner side wall panel 14", the lid portion outer side wall panel 24', and the lid portion inner side wall panel 24" are folded through ninety degrees about the first score line 60, the fourth score line 66, the fifth score line 70, the seventh score line 74, the sixth score line 72, and the eighth score line 76, respectively, into overlaying relationship and the inner surface of each of the outer wall panels 12', 14', 22' and 24' adhered to the outer surface of the corresponding inner wall panel 12", 14", 22"and 24".

Before the outer bottom wall panels 12' and 22', the inner bottom wall panels 12" and 22", the outer side wall panels 14' and 24', and the inner side wall panels 14" and 24" of the body portion 2 and the lid portion 4, respectively, are folded about the first score line 60, the fourth score line 66, the fifth score line 70, the sixth score line 72, the seventh score line 74 and the eighth score line 76, the body portion bottom wall flap 78, the lid portion bottom wall flap 82, the body portion top wall flap 86 and the lid portion top wall flap 90 are folded through ninety degrees about the ninth score line 80, the tenth score line 84, eleventh score line 88 and the twelfth score line 92, respectively. Once erected, the body portion bottom wall flap 78 and the body portion top wall flap 86, and the lid portion bottom wall flap 82 and the lid portion top wall flap 90 are thus located within the body portion 2 and lid portion 4 of the container, overlying the body portion inner side wall panel 14" and the lid portion inner side wall panel 24", respectively.

As shown in FIG. 2, to facilitate folding of the blank, the width of the body portion outer side wall panel 14' and the lid portion outer side wall panel 24', in the transverse direction of the blank, is slightly greater than the width of the body portion inner side wall panel 14" and the lid portion inner side wall panel 24", and the width of the body portion outer bottom wall panel 12' and the lid portion outer bottom wall panel 22', in the longitudinal direction of the blank, is slightly greater than the width of the body portion inner bottom wall panel 12" and the lid portion inner bottom wall panels 22". In addition, the ninth score line 80 and the eleventh score line 88, and the tenth score line 84 and the twelfth score line 92 are offset relative to the fifth score line 70 and the sixth score line 72, respectively, in the transverse direction of the blank, towards the hinge line 26' and the cut 68, by a distance approximately equal to the thickness of the blank.

Figure 3:
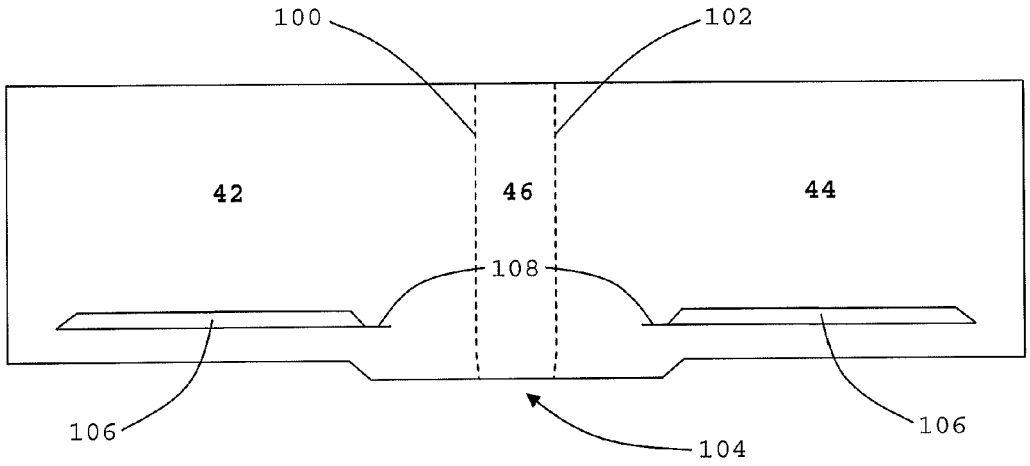
FIG. 3 is a plan view of the outer face of an elongate laminar blank for forming the inner frame of the side-opening hinge-lid container of FIGS. 1*a* and 1*b;*

With reference to FIG. 3, the elongate laminar blank from which the inner frame 40 of the hinge-lid container of FIGS. 1*a* and 1*b* is erected includes a front wall panel 42, a top wall panel 46 and a rear wall panel 44, which are separated from one another in the longitudinal direction of the blank by a transverse first score line 100 and a parallel, transverse second score line 102, respectively. The front wall panel 42, the top wall panel 46 and the rear wall panel 44 are of a similar length, in the longitudinal direction of the blank, as the body portion front wall panel 6 and the lid portion front wall panel 16, the body portion top wall panel 10 and the lid portion top wall panel 20, and the body portion rear wall panel 8 and the lid portion rear wall panel 18, respectively, of the blank shown in FIG. 2.

A protrusion 104 having opposed slanted sides extends from one of the longitudinal side edges of the blank of FIG. 3, across the top wall panel 46 and the upper adjacent portions of the front wall panel 42 and the rear wall panel 44. Distant from the protrusion 104, the width of the front wall panel 42 and the rear wall panel 44, in the transverse direction of the blank, is substantially the same as the width of the body portion front wall panel 6 and the body portion rear wall panel 8, respectively, of the blank shown in FIG. 2. Two collinear slots 106 extending in the longitudinal direction of the blank are provided in the front wall panel 42 and the rear wall panel 46, respectively, proximate the protrusion 104. A slit 108 extends from the end of each slot 106 proximate the top wall panel 46 in the longitudinal direction of the blank.

During erection of the inner frame 40 of the hinge-lid container of FIGS. 1*a* and 1*b* from the blank shown in FIG. 3, the front wall panel 42 and the rear wall panel 44 are folded through ninety degrees about the first score line 100 and the second score line 102, respectively, so that they are perpendicular to the top wall panel 46. As shown in FIG. 1*b*, the erected inner frame 40 is mounted in the body portion 2 of the formed hinge-lid container so that the protrusion 104 extending from the upper regions of the front wall panel 42, the rear wall panel 44 and the top wall panel 46 projects from the body portion 2 into the space covered by the lid portion 4 in the closed position. To retain the inner frame 40 in position in the body portion 2 of the formed hinged-lid container, a portion of the outer surface of the front wall panel 42 and a portion of the outer surface of the rear wall panel 44 of the inner frame 40, distant from the longitudinal slots 106, is adhered to the inner surface of the body portion front wall panel 6 and the inner surface of the body portion rear wall panel 8, respectively, and/or the outer surface of the top wall panel 46 of the inner frame 40 is adhered to the inner surface of the body portion top wall panel 10.

Figure 4:
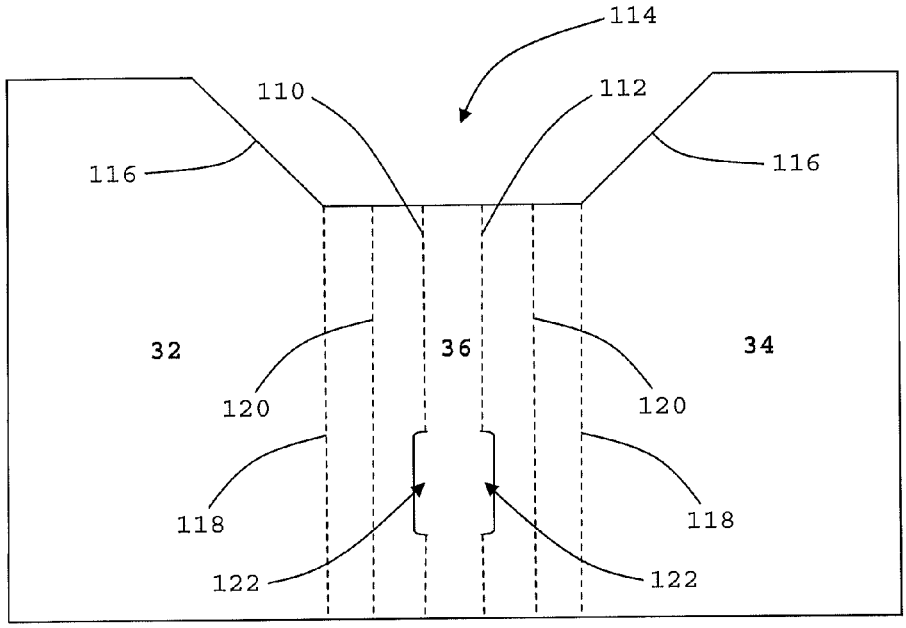
FIG. 4 is a plan view of the outer face of a laminar blank for forming the body portion liner of the side-opening hinge-lid container of FIGS. 1*a* and 1*b*.

With reference to FIG. 4, the laminar blank from which the body portion liner 30 of the hinge-lid container of FIGS. 1*a* and 1*b* is erected includes a front wall panel 32 and a rear wall panel 34, which are disposed on either side of a central side wall panel 36 to which they are connected along a first score line 110 and a parallel second score line 112, respectively. A notch 114 having opposed slanted sides 116 is provided in the upper longitudinal edge of the blank and extends across the side wall panel 36 into the front wall panel 32 and the rear wall panel 34. Distant from the notch 114, the front wall panel 32 and the rear wall panel 34 are of a similar length, in the transverse direction of the blank, as the body portion front wall panel 6, the lid portion front wall panel 16, the body portion rear wall panel 8 and the lid portion rear wall panel 18 of the blank for forming the body portion 2 and the lid portion 4 shown in FIG. 2, and the front wall panel 42 and the rear wall panel 44 of the blank for forming the inner frame 40 shown in FIG. 3. A pair of parallel third score lines 118 that extend perpendicularly between the base of the notch 114 and the lower longitudinal edge of the blank are provided in the front wall panel 32 and the rear wall panel 34 of the blank. A pair of parallel fourth score lines 120 that also extend perpendicularly between the base of the notch 114 and the lower longitudinal edge of the blank, between the pair of parallel third score lines 118 and the first score line 110 and the second score line 112, respectively, are also provided in the front wall panel 32 and the rear wall panel 34. A pair of opposed ears 122 cut from the front wall panel 32 and the rear wall panel 34 along the first score line 110 and the second score line 112, respectively, extend from the side wall panel 36 in a lower region thereof distant from the notch 114.

During erection of the body portion liner 30 from the blank shown in FIG. 4, the front wall panel 32 and the rear wall panel 34 are folded through ninety degrees about the first score line 110 and the second score line 112, respectively, so that they are perpendicular to the side wall panel 36 and the opposed ears 122 provided on the side wall panel 36 extend substantially perpendicularly to the plane of the front wall panel 32 and the rear wall panel 34. As shown in FIG. 1*b*, the erected body portion liner 30 is mounted in the body portion 2 of the formed hinge-lid container, adjacent the inner frame 40, so that the regions of the front wall panel 32 and the rear wall panel 34 of the body portion liner 30 between the pair of parallel third score lines 118 and the first score line 110 and the second score line 112, respectively, project, together with the side wall panel 36, from the body portion 2 into the space covered by the lid portion 4 in the closed position. To retain the body portion liner 30 in position in the body portion 2 of the formed hinged-lid container, an upper portion of the outer surface of the front wall panel 32 and an upper portion of the outer surface of the rear wall panel 34 of the body portion liner 30, proximate the opposed slanted edges 116 of the notch 114, is adhered to the inner surface of the front wall panel 42 and the rear wall panel 44, respectively, of the inner frame 40, which, as described above, is in turn adhered to the inner surface of the body portion 2.

As a result of the pair of parallel third score lines 118 and the pair of parallel fourth score lines 120 provided in the front wall panel 32 and the rear wall panel 34 of the blank shown in FIG. 4, the front wall 32 and the rear wall 34 of the erected body portion liner 30 taper inwardly to the vertical edges of the side wall 36 thereof, which is of considerably reduced width compared to the body portion side wall 14 and the lid portion side wall 24 of the hinge-lid container; for simplicity the pair of parallel third score lines 118 and the pair of parallel fourth score lines 120 have been omitted from FIG. 1*b*. Where the formed hinge-lid container is used to house elongate smoking articles such as cigarettes, the tapering of the front wall 32 and the rear wall 34 of the body portion liner 30 advantageously results in a single cigarette housed in the body portion 2 being presented to the consumer for removal from the projecting portion of the body portion liner 30 when the hinged-lid container is in the open position shown in FIG. 1*b*. Where the formed hinge-lid container is used to package cigarettes, the width of the side wall 36 of the body portion liner 30 is preferably approximately equal to or slightly greater than the diameter of the cigarettes housed in the container.

Figure 5:
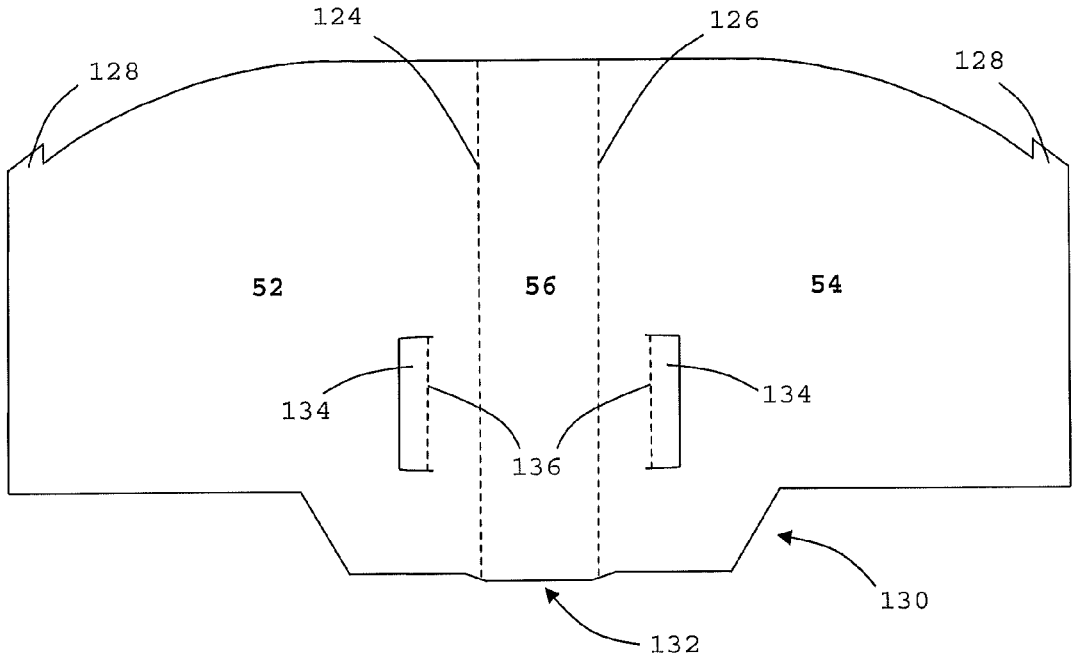
FIG. 5 is a plan view of the outer face of a laminar blank for forming the lid portion liner of the side-opening hinge-lid container of FIGS. 1*a* and 1*b*.

With reference to FIG. 5, the laminar blank from which the lid portion liner 50 of the hinge-lid container of FIGS. 1*a* and 1*b* is erected includes a front wall panel 52 and a rear wall panel 54, with convex arcuate upper edges, which are connected along a first score line 124 and a parallel second score line 126, respectively, to the opposed elongate sides of a rectangular central side wall panel 56. A pair of opposed lugs 128 having slanted upper edges extend from the outer ends of the upper arcuate edges of the front wall panel 52 and the rear wall panel 54 distant from the central side wall panel 56. A first protrusion 130 having opposed slanted sides extends from the lower longitudinal edge of the blank, across the central side wall panel 56 and adjacent portions of the front wall panel 52 and the rear wall panel 54. A smaller, second protrusion 132 also having opposed slanted sides extends from the first protrusion across the central side wall panel 56. A pair of opposed elongate flaps 134 are cut from lower portions of the front wall panel 52 and the rear wall panel 54 proximate the central side wall panel 56. Each flap 134 is defined by a relatively long cut extending parallel to the first score line 124 and the second score line 126 and by a pair of opposed relatively short cuts extending perpendicularly from the ends of the relatively long cut towards the central side wall panel 56. The flaps 134 are hingedly connected to the front wall panel 52 and the rear wall panel 54, respectively, along a pair of parallel third score lines 136, extending between the pair of opposed relatively short cuts, parallel to the first score line 124 and the second score line 126.

During erection of the lid portion liner 50 from the blank shown in FIG. 5, the front wall panel 52 and the rear wall panel 54 are folded through ninety degrees about the first score line 124 and the second score line 126, respectively, so that they are perpendicular to the central side wall panel 56. The flaps 134 in the front wall panel 52 and the rear wall panel 54 are folded inwardly through ninety degrees about the pair of parallel third score lines 136, so that they are perpendicular to the front wall panel 52 and the rear wall panel 54, and parallel to the central side wall 56. As shown in FIG. 1*b*, the erected lid portion liner 50 is mounted in the lid portion 4 of the formed hinge-lid container with the outer surface of the central side wall 56 of the lid portion liner 50 adjacent the inner surface of the lid portion side wall 24, so that the edges of the front wall panel 52 and the rear wall panel 54 of the lid portion liner 50 distant from the side wall panel 56 project beyond the front wall 16 and the rear wall 18, respectively, of the lid portion 4 into the body portion 2 of the container. To retain the lid portion liner 50 in position in the formed hinge-lid container, the outer surface of the central side wall 56 thereof is adhered to the inner surface of the lid portion side wall 24.

At a convenient stage during erection of the hinge-lid container, the ends of the front wall panel 52 and the rear wall panel 54 of the lid portion liner 50 that project into the body portion 2 of the formed container are passed through the slots 106 provided in the front wall panel 42 and the rear wall panel 44, respectively, of the inner frame 40. In formed hinge-lid container, the portions of the front wall 52 and the rear wall 54 of the lid portion liner 50 that project beyond the front wall 16 and the rear wall 18, respectively, of the lid portion 4 are thus slidingly engaged between the inner surface of the front wall 42 of the inner frame 40 and the outer surface of the front wall 32 of the body portion liner 30, and the inner surface of the rear wall 44 of the inner frame 40 and the outer surface of the rear wall 34 of the body portion liner, respectively.

It will be appreciated that the precise order in which the various panels of the blanks of FIGS. 2 to 5 are folded and adhered to one another to form the hinge-lid container of FIGS. 1*a* and 1*b* may be varied depending upon, for example, the apparatus used to produce the formed container and/or the nature of the consumer goods to be packaged therein. Where hinge-lid containers according to the invention are employed to package cigarettes or other elongate smoking articles, the blanks shown in FIGS. 2 to 5 may be placed together with a bundle of cigarettes wrapped in, for example, metallised paper or aluminium foil in a pocket on a wrapping wheel that is indexable between a number of stations and, as the pocket indexes around from station to station, the blanks folded in stages around the wrapped bundle of cigarettes to form the hinge-lid container as is well known in the art.

In use, to open the hinge-lid container the consumer pulls the front wall 16, the rear wall 18 and/or the top wall 20 wall of the lid portion 4 away from the corresponding walls 6, 8 and 20 of the body portion 2, thereby causing the lid portion 4 to pivot downwardly away from the body portion 2 about the hinge line 26 from the closed position shown in FIG. 1*a* to the open position shown in FIG. 1*b*. As the lid portion 4 pivots about the hinge line 26, the ends of the front wall 52 and the rear wall 54 of the lid portion liner 50 distant from the side wall panel 56 thereof, which are held between the inner surface of the front wall 42 of the inner frame 40 and the outer surface of the front wall 32 of the body portion liner 30, and the inner surface of the rear wall 44 of the inner frame 40 and the outer surface of the rear wall 34 of the body portion liner, respectively, slide through the slots 106 provided in the front wall 42 and the rear wall 44, respectively, of the inner frame 40, away from the body portion 2.

During opening and closing of the hinge-lid container, the frictional force generated between the outer surfaces of the front wall 52 and the rear wall 54 of the lid portion liner 50 and the inner surfaces of the front wall 42 and the rear wall 44 of the inner frame 40, respectively, and the frictional force generated between the inner surface of the front wall 52 and the rear wall 54 of the lid portion liner 50 and the outer surface of the front wall 32 and the rear wall 34 of the body portion liner 30, holds the lid portion liner 50 and hence the lid portion 4 in any position between the fully closed position shown in FIG. 1*a* and the fully open position shown in FIG. 1*b* until a positive force is applied by the consumer to further pivot the lid portion 4 about the hinge line 26.

When the lid portion 4 reaches the fully open position shown in FIG. 1*b*, the pair of opposed lugs 128 extending from the outer ends of the upper arcuate edges of the front wall panel 52 and the rear wall panel 54 of the lid portion liner 50 cooperate with the slits 108 extending from the upper ends of the slots 108 provided in the front wall 42 and the rear wall 44, respectively, of the inner frame 40 to prevent the ends of the front wall 52 and the rear wall 54 of the lid portion liner 50 distant from the side wall 56 thereof from exiting the slots 108 in the inner frame 40. Further pivotal movement of the lid portion 4 relative to the body portion 2 beyond the open position shown in FIG. 1*b* is thus prevented.

To subsequently close the hinge-lid container, the consumer pushes, for example, on the side wall 24 of the lid portion 4 to cause the lid portion 4 to pivot upwardly towards the body portion 2 about the hinge line 26. As the lid portion 4 is pivoted from the fully open position shown in FIG. 1*b* back to the fully closed position shown in FIG. 1*a*, the leading surfaces of the inwardly folded flaps 134 extending from the front wall 52 and the rear wall 54 of the lid portion liner 50 engage the corresponding facing surfaces of the opposed ears 122 extending outwardly from the side wall 36 of the body portion liner 30. The force exerted on the inwardly folded flaps 134 by the outwardly extending ears 122 as a result of continued pivotal movement of the lid portion 4 towards the closed position shown in FIG. 1*a* causes the flaps 134 to pivot backwards about the score lines 136, away from the body portion 2, to a position substantially parallel to the front wall 52 and the rear wall 54 of the lid portion liner 50. When, as a result of further pivotal movement of the lid portion 4 towards the closed position, the trailing outer edges of the flaps 134 have passed over the ears 122, and hence the force exerted on the flaps 134 by the ears 122 has been removed, the flaps 134 snap back across the outer longitudinal edges of the ears 122 to their original position, substantially perpendicular to the front wall 52 and the rear wall 54 of the lid portion liner 50, producing a "clicking" sound.

As well as providing the consumer with an audible indication of closure of the hinge-lid container, analogous engagement between the flaps 134 provided on the lid portion liner 50 and the ears 122 provided on the body portion liner 30 during opening of the hinge-lid container advantageously prevents movement of the lid portion 4 from the fully closed position shown in FIG. 1*a* to the fully open position shown in FIG. 1*b* unless the consumer applies sufficient pivotal force to the lid portion 4 to result in the flaps 134 being pivoted forwards about the score lines 136, towards the body portion 2, by the ears 122, to a position substantially parallel to the front wall 52 and the rear wall 54 of the lid portion liner 50. Once again, when as a result of continuing pivotal movement of the lid portion 4 by the consumer towards the open position, the trailing outer edges of the flaps 134 have passed over the ears 122, and hence the force exerted on the flaps 134 by the ears 122 has been removed, the flaps 134 return to their original position, substantially perpendicular to the front wall 52 and rear wall 54 of the lid portion liner 50.

By, for example, modifying the blank for forming the lid portion liner 50 shown in FIG. 5 to change the direction in which the flaps 134 are folded relative to the body portion liner 30, such that the flaps snap back across the outer longitudinal edges of the ears 122 to produce a "clicking" sound during movement of the hinge-lid container from the fully closed position to the fully open position, the hinge lid container of FIGS. 1*a* and 1*b* may be readily adapted to provide the consumer with an audible indication of opening, rather than closure.

Furthermore, it will be appreciated that through appropriate choices of, for example, the relative dimensions, positions and orientations of the at least one flap and the at least one ear thereof, hinge-lid containers according to the invention may be provided wherein the at least one flap engages the at least one ear to produce a sound during movement of the lid portion from the open position to the closed position and from the closed position to the open position, thereby advantageously providing the consumer with an audible indication of both closure and opening of the container.

While the invention has been exemplified with reference to the packaging of cigarettes, it will be appreciated that hinge-lid containers according to the invention may also be advantageously employed to package a variety of other consumer goods such as, for example, cosmetics, confectionery products and other foodstuffs.

The invention claimed is:

1. A side-opening hinge-lid container containing a plurality of elongate smoking articles comprising:

a body portion having a front wall, a rear wall, a top wall and a bottom wall;

a lid portion having a front wall, a rear wall, a top wall and a bottom wall, the lid portion being connected to the body portion along a hinge line for pivotal movement between a closed position, in which the interior of the body portion is inaccessible, and an open position, in which at least a portion of the interior of the body portion is accessible;

a body portion liner having a front wall, a rear wall and a side wall, the body portion liner being mounted in the body portion and projecting sideways therefrom into a space covered by the lid portion in the closed position;

a pair of outwardly extending ears mounted on the body portion liner;

a pair of inwardly extending flaps hingedly mounted in the lid portion for pivotal movement relative thereto;

a lid portion liner mounted in the lid portion, the lid portion liner having a front wall and a rear wall, and including the pair of inwardly extending flaps; and an inner frame mounted between the body portion and the body portion liner, the front wall and the rear wall of the lid portion liner being slidably engaged in the pair of slots provided in a front wall and/or a rear wall, respectively, of the inner frame;

wherein during pivotal movement of the lid portion from the open position to the closed position and/or during pivotal movement of the lid portion from the closed position to the open position the pair of flaps engages the pair of ears to produce a sound; and wherein the front wall and/or the rear wall of the lid portion liner project from the lid portion in the closed position sideways into the body portion.

2. A side-opening hinge-lid container according to claim 1 wherein the front wall, the rear wall, the top wall and the bottom wall of the lid portion are parallel to and abut the front wall, the rear wall, the top wall and the bottom wall, respectively, of the body portion in the closed position.

3. A side-opening hinge-lid container according to claim 1 wherein the front wall, the rear wall and the top wall of the lid portion are spaced apart from the front wall, the rear wall and the top wall, respectively, of the body portion in the open position.

4. A side-opening hinge-lid container according to claim 1 wherein the bottom wall of the lid portion is connected to the bottom wall of the body portion along the hinge line.

5. A side-opening hinge-lid container according to claim 1 comprising a pair of opposed outwardly extending ears mounted on the body portion liner and a pair of opposed inwardly extending flaps hingedly mounted in the lid portion, wherein during pivotal movement of the lid portion from the open position to the closed position and/or during pivotal movement of the lid portion from the closed position to the open position the pair of opposed flaps engage the pair of opposed ears to produce a sound.

6. A side-opening hinge-lid container according to claim 5 wherein the at least one inwardly extending flap is hingedly mounted on the front wall of the lid portion and/or the rear wall of the lid portion for pivotal movement relative thereto.

7. A side-opening hinge-lid container according to claim 5 wherein the front wall of the body portion liner and/or the rear wall of the body portion liner project from the lid portion in the closed position sideways into the body portion.

8. A side-opening hinge-lid container according to claim 1 further comprising an inner frame mounted between the body portion and the body portion liner.

* * * * *